United States Patent [19]

Gelati

[11] Patent Number: 4,768,976

[45] Date of Patent: Sep. 6, 1988

[54] ELECTRICAL CONNECTOR

[76] Inventor: Bruno Gelati, Via Tre Castelli, 6, 20142-Milan, Italy

[21] Appl. No.: 82,435

[22] Filed: Aug. 6, 1987

[51] Int. Cl.[4] ..... H01R 4/24

[52] U.S. Cl. ..... 439/441

[58] Field of Search ..... 439/436–441

[56] References Cited

U.S. PATENT DOCUMENTS 3,474,389 10/1969 Nagano ..... 439/440

FOREIGN PATENT DOCUMENTS 1918193 10/1970 Fed. Rep. of Germany ..... 439/436

2619035 11/1977 Fed. Rep. of Germany ..... 439/439

*Primary Examiner*—Joseph H. McGlynn

*Attorney, Agent, or Firm*—Bucknam and Archer

[57] ABSTRACT

A terminal block for the electrical connection of conductor wires or cables has one or a plurality of adjacent and mutually connected box-like bodies (1) in the end walls of which are formed apertures for receiving the ends of wires to be connected.

Within these box-like bodies there is a three dimensional structure (6) shaped in trapezoidal form, made of elastic, electrically conductive material, having its shorter side defined by a reaction plate (10) projecting beyond the two inclined sides of the trapezoidal form itself, and the dimension of which, in plan, reproduced that of a plate defining the longer side.

Levers (16) having underlying teeth (17) may be provided to press the tongues (8) away from the reaction plate (10) to facilitate insertion of a wire, or a cover may be provided with holes to allow a tool to be introduced for this purpose.

8 Claims, 2 Drawing Sheets

ELECTRICAL CONNECTOR

The present invention relates to an improved terminal block for the electrical connection of rigid or flexible electrical wires or cables.

At present there are various types of multiple terminal block available on the market, and these are capable of forming extremely practical electrical connection and branching systems, of almost limitless durability, which can be disconnected and reconnected quite easily. These terminal blocks are constituted by a plurality of adjacent and mutually connected terminals provided with pairs of holes, interconnected by conductive bodies into which a conductor can be introduced and clamped with a screw. These conventional terminal blocks require a tool to be used for tightening and removal of the screws, and this of course takes up a not inconsiderable operating time for correct manipulation of the screws themselves. Moreover, with these conventional terminal blocks it is not in general possible to make branching connections in a simple manner, particularly after the main connection has been made.

The object of the present invention is that of providing a terminal block for the connection of electrical conductor wires or cables, which will be of a structure such as to facilitate the electrical and mechanical fixing of the wires or cables to the terminal body in a manner which avoids the above-indicated disadvantages.

According to the present invention, there is provided a terminal block for the electrical connection of conductor wires or cables, characterised by the fact that it essentially comprises a generally rectangular box-like body having at least one aperture in each opposite end wall thereof and housing within it a generally trapezoidal three dimensional structure made of electrically conductive elastic material, the shorter parallel side of the trapezoidal structure being defined by a reaction plate which projects beyond the two inclined sides of the trapezoidal structure, which latter sides are formed as elastic tongues integral with a plate constituting the longer parallel side of the trapezoidal structure with the free ends of the tongues closely adjacent the face of the reaction plate such that the free end of a conductor wire or cable inserted through the corresponding aperture in the adjacent end wall of the box-like body can be introduced between the reaction plate and the free end of the adjacent inclined tongue and retained thereby.

One advantage of the present invention is that it provides an improved terminal block which allows the interconnection of both rigid and flexible electrical conductor wires or cables.

Another advantage of the present invention is that it provides an improved terminal block having smaller dimensions than conventional terminal blocks but which is readily interchangeable with conventional screw-type terminal blocks.

Preferably, within the box-like bodies there is housed a three dimensional structure shaped in the form of a trapezoid, made of an elastic electrically conductive material, the shorter parallel side of which is defined by a plate which also projects beyond the two inclined sides of the trapezoidal form itself, and the dimensions of which, in plan, match those of the major base.

On opposite ends of the box-like body there are formed apertures to receive the ends of conductive wires, and in the upper face of the box-like body and in the said plate defining the shorter side of the trapezoid there are formed openings in corresponding positions to receive a tool or other means for facilitation of an electrical connection as will be described in more detail below.

Two embodiments of the present invention will now be more particularly described, by way of example, with reference to the accompanying drawings, in which.

Figure 1:
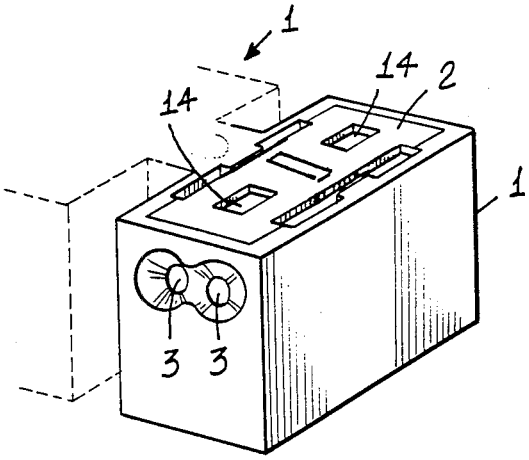
FIG. 1 is a perspective schematic view of a terminal block formed as a first embodiment of the invention.
Figure 2:
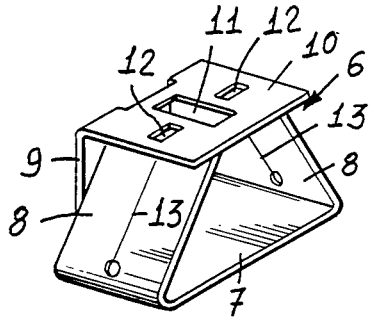
FIG. 2 is a perspective view of the elastic electrical connection structure housed within the terminal block shown in FIG. 1.
Figure 3:
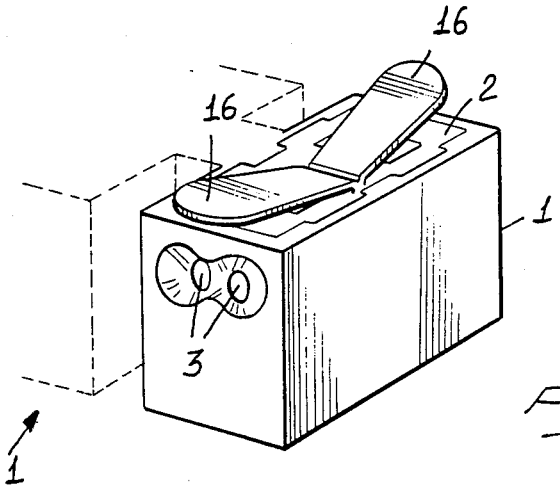
FIG. 3 is a perspective view of a second embodiment of a terminal, provided with upper lever elements capable of acting on this elastic structure to assist in making an electrical connection.
Figure 4:
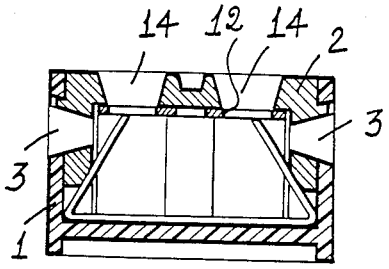
FIGS. 4 and 5 are, respectively, a longitudinal vertical section through the terminal block of FIG. 1 and a section through the same terminal block during connection of a conductive wire.

Referring now to the drawings, the improved terminal block of the invention is constituted by a plurality of generally rectangular box-like bodies 1, laterally interconnected together, and each closed by an upper cover 2. In the two opposite end walls of these rectangular box-like bodies there are two openings 3 having respective frusto-conical longitudinal entrance sections to facilitate the introduction of the ends 4 of conductor wire 5 to be connected. In other embodiments (not shown) there may be only one such opening in each end, or there may be more than two such openings. Within these box-like bodies there is housed a three dimensional conductor structure 6 having a substantially trapezoidal form, preferably made of stainless steel or, in any event, of a material which is conveniently elastic and a good conductor of electricity.

This conductor structure is constituted by a base plate 7 folded upwardly at each end to form two inclined tongues 8 converging towards their free ends, and at one side to form a side wall 9 laterally from which projects an upper portion 10 which overlies the inclined side tongues and projecting over these to form a reaction plate the function of which will be explained hereinbelow.

The said reaction plate has an intermediate slot 11 extending transversely of the length of the block with two longitudinally extending slots 12 one on each side of it. The inclined tongues 8 are divided longitudinally into two portions by means of a corresponding slit 13.

Figure 5:
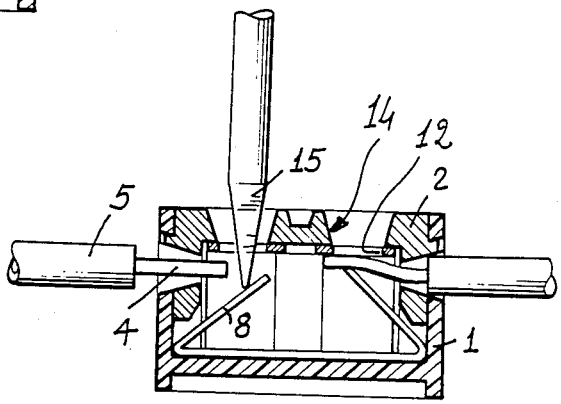

The cover 2 for closure of the box-like body 1 has apertures 14 in positions corresponding to those of the slots 12 in the reaction plate 10 to permit the passage of the tip of a screwdriver 15 or like tool for the purpose of causing flexure of one or the other of the tongues 8 as illustrated in FIG. 5. In this way the insertion of the end of a flexible wire between a tongue 8 and the reaction plate 10 of the structure 6 is, as is illustrated in FIG. 5, considerably facilitated; when the tool is removed the tongue 8 springs back pressing the wire into contact with the reaction plate 10 making a mechanical and an electrical connection simultaneously.

Figure 6:
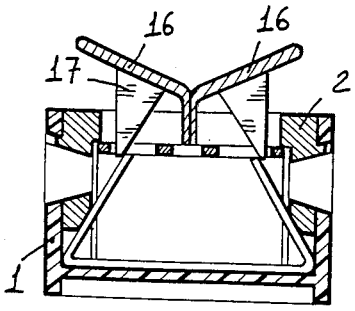
FIGS. 6 and 7 are, respectively, a vertical section through the terminal block of FIG. 3, and a section through the same block during connection of a conductive wire.
Figure 7:
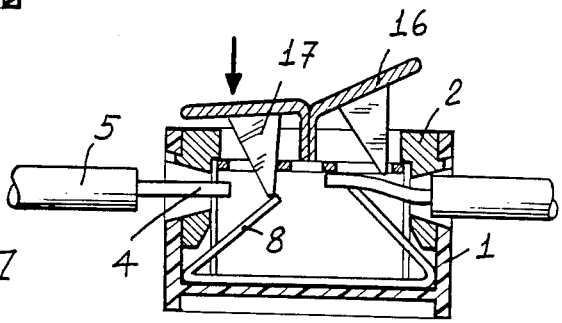

As shown in the embodiment of FIGS. 6 and 7 a cover with levers 16 incorporated directly by moulding in the cover itself can advantageously be provided. Such levers, may advantageously have different colours for a more rapid identification of the poles; each lever is provided with an underlying plastic tooth 17 capable of acting, as shown in FIG. 7, on the tongues 8 of the structure 6.

I claim:

1. A terminal block for the electrical connection of conductor wires or cables, characterised by the fact that it essentially comprises a generally rectangular box-like body (1) having at least one aperture (3) in each opposite end wall thereof and housing within it a generally trapezoidal three dimensional structure (6) made of electrically conductive elastic material, the shorter parallel side of the trapezoidal structure being defined by a reaction plate (10) which projects beyond the two inclined sides of the trapezoidal structure, which latter sides are formed as elastic tongues (8) integral with a plate constituting the longer parallel side of the trapezoidal structure with the free ends of the tongues (8) closely adjacent the face of the reaction plate (10) such that the free end of a conductor wire or cable inserted through the corresponding aperture in the adjacent end wall of the box-like body (1) can be introduced between the reaction plate (10) and the free end of the adjacent inclined tongue (8) and retained thereby.

2. A terminal block according to claim 1, characterised by the fact that the said one side face of the box-like body (1) is formed as a closure cover (2) and has openings (14) therein in positions such as to allow the insertion of a tool to press the free end of a tongue (8) away from the reaction plate (10) to permit a flexible, conductor wire inserted through the aperture (3) in the end wall of the box-like body to be introduced freely between the free end of the tongue (8) and the reaction plate (10).

3. A terminal block according to claim 1, characterised by the fact that the said three dimensional structure (6) is made of an elastic conductive material, such as stainless steel and the said inclined tongues (8) are formed by bending tabs at the ends of a base plate (7) to form the upwardly converging sides of the trapezoidal shape, and the reaction plate (10) is integrally formed with a side wall (9) formed by bending a tab extending from one side of the base plate (7).

4. A terminal block according to claim 1, characterised by the fact that the said reaction plate has two apertures (12) therein and the adjacent side face of the box-like body has openings (14) in positions corresponding to the positions of the apertures (12) in the reaction plate, whereby to permit the introduction of a tool to press the adjacent tongue (8) away from the reaction plate (10) whereby to facilitate free insertion of a flexible conductor wire between the reaction plate (10) and the tongue (8).

5. A terminal block according to claim 1, characterised by the fact that the said inclined tongues (8) are separated into two parts by a longitudinally extending slit (13).

6. A terminal block according to claim 1, characterised by the fact that the side face of the box-like body (1) adjacent the reaction plate (10) is formed as a cover provided with a pair of levers (16) obtained by moulding jointly with the cover itself, these levers (16) being each provided with an underlying plastics tooth for engagement with the adjacent tongue (8).

7. A terminal block according to claim 1, characterised in that the opening or openings (3) in each end wall of the box-like body (1) have frusto-conical entrance portions to facilitate insertion of a conductor wire therein.

8. A terminal block according to claim 6, characterised in that the levers (16) are of different colours to facilitate identification of the polarity of the electrical connection made by the terminal block.

* * * * *